United States Patent [19]

Wessel

[11] Patent Number: 4,466,265

[45] Date of Patent: Aug. 21, 1984

[54] COMPOUND TOOL FOR HOT-WORKING

[75] Inventor: Otto Wessel, Duisburg, Fed. Rep. of Germany

[73] Assignee: Mannesmann A.G., Duesseldorf, Fed. Rep. of Germany

[21] Appl. No.: 361,806

[22] Filed: Mar. 25, 1982

[30] Foreign Application Priority Data

Apr. 3, 1981 [DE] Fed. Rep. of Germany ..... 3114177

[51] Int. Cl.[3] ..... B21B 19/04

[52] U.S. Cl. ..... 72/97; 72/209; 76/101 R; 164/99; 428/553

[58] Field of Search ..... 76/101 R, 101 A; 428/550, 553; 164/99; 72/97, 209, 478, 476

[56] References Cited

U.S. PATENT DOCUMENTS

| | | | |
|---|---|---|---|
| 2,413,989 | 1/1947 | Molner et al. | 76/101 A |
| 2,944,323 | 7/1960 | Stadler | 76/101 R |
| 4,393,677 | 7/1983 | Tamura et al. | 72/97 |

FOREIGN PATENT DOCUMENTS

| | | | |
|---|---|---|---|
| 672257 | 2/1939 | Fed. Rep. of Germany | 76/101 R |
| 1758162 | 12/1972 | Fed. Rep. of Germany . | |
| 72709 | 5/1982 | Japan | 72/209 |
| 379047 | 8/1932 | United Kingdom | 76/DIG. 11 |
| 596306 | 3/1978 | U.S.S.R. | 72/209 |

*Primary Examiner*—Roscoe V. Parker

*Attorney, Agent, or Firm*—Ralf H. Siegemund

[57] ABSTRACT

The compound tool is made from a powder-metallurgically-prepared portion, establishing the wear-resisting zones onto which a carrier body is cast from steel.

11 Claims, 4 Drawing Figures

Fig.1
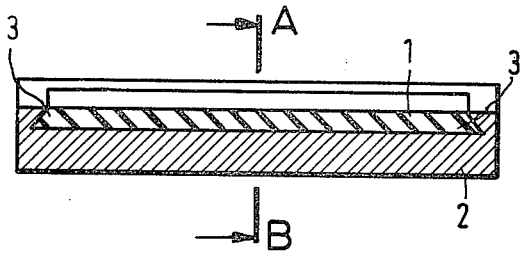
Fig.2
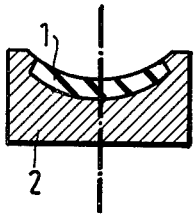
Fig.3
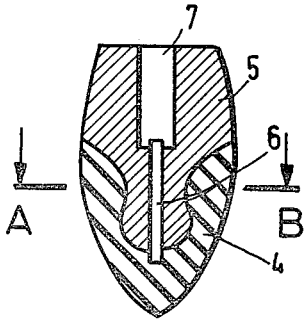
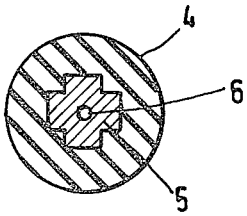
Fig.4

COMPOUND TOOL FOR HOT-WORKING

BACKGROUND OF THE INVENTION

The present invention relates to the method of making a tool to be used for hot-shaping of steel and other heavy metals; and more particularly, the invention relates to the making of a tool in a configuration of a compound construction part, including several metallical shapes and components, including, in particular, a basic tool or carrier element and a wear-resistant component, in a composite configuration.

Metallic compound parts, wherein two or more components of different materials are used but which are inseparately secured to each other, are known in many configurations. Usually, one provides a basic body or carrier and adds layers or lamina thereto, these additions being made of a material that depends upon the ultimate use of the particular part so made; the same, of course, is true with regard to the basic boy. The layering or depositing of the supplementary material could be carried out through galvanizing, welding, cladding, plating, or sintering of a metal powder upon the metallic, basic carrier body, usually consisting of a different material. Such a compound element is, for example, described in German printed patent application No. 17 58 162.

Powder metallurgy is a well-developed field of art; and herein, it is known to make compound parts. For example, a porous, powder-made skeleton is impregnated with a liquified component, such as copper, which will, of course, solidify inside the pores of the steel powder skeleton.

The methods described above are, however, limited to the making of compound parts which are relatively simple as far as their overall configuration is concerned. Complex shapes wherein for example the surface in a certain area or in several zones are to be made from a different material under exclusion of for example other surface parts cannot be made by any of the methods described above or not at least without great difficulties and certainly not in the general case. In other words, the afore-mentioned methods are restricted in their application with regard to the surface contour of the basic part!

A particular compound part which is desired to be made is, for example, a tool that is to be used in the hot-deforming and shaping of steel. Such a tool has certain zones which are to be provided with particular and especially wear- and ablation-proof material. Such a wear zone needs to be provided particularly in the case of hot-shaping tools; but it is believed that, heretofore, no adequate method does exist for making such a tool. A particular tool of interest is, for example, the billet guide in oblique rolling mills provided for making and working seamless steel pipes.

It is known generally that parts made on the basis of powder metallurgy and including particularly steel, nickel, or cobalt alloy powders, are highly resistive to wear. This resistiveness becomes particularly noticeable if such a part is used in heat-shaping and forming of steel. For example in the journal "Powder Metallurgy", Third European P. M. Symposium 1971, Conference Supplment Part 1, pp. 193–208, has been described a die for the extrusion of steel which, of course, is an element that will be subjected to wear in a rather extreme manner. The paper suggests here to construct such a die from a chrome nickel steel powder and make it by means of powder metallurgy. Such a ring is to be mounted in a forged holder. The compound state is obtained by shrinking the ring into the holding ring. It can be seen, however, that, in the case of large and/or complexly shaped hot-working tools, such an approach may be very difficult; and maybe, they are even too difficult to make and, most certainly, quite expensive. This is particularly true with regard to the making of a tool of complex configuration, and to making it in its entirety powder metallurgically under utilization of a processed steel alloy powder.

Billet or rolling stock guiding equipments have not been constructed in their entirety from powder, but as compound parts including, in each instance, a basic element, carrier, or component, and including further powder-metallurgically-made additions for the critical portions that are subjected to a high degree of wear. For this purpose, the basic body or component and the wear-resisting additions and supplementary components are mechanically worked and finished and joined by means of bolts. It can readily be seen that this procedure requires generally a rather extensive effort of matching and fitting until highly accurately matching surfaces for mutual engagement have been obtained.

DESCRIPTION OF THE INVENTION

It is an object of the present invention to provide a new and improved method for making hot-working tools, such tools to be provided for avoiding the difficulties and problems outlined above.

It is another object of the present invention to provide a new and improved method for making hot-working tolls, which method is not only more economical but is applicable in a manner that is not restricted as far as the contour and shape of the tool to be made is concerned.

It is another object of the present invention to provide new and improved hot-working tools.

In accordance with the preferred embodiment of the present invention, it is suggested to provide a hot-working tool in the following manner and, in particular, as a compound element or part to be made as follows. A first part is made on the basis of powder-metallurgically press-working a high-alloyed steel and/or nickel and/or cobalt powder, the part having a first contour surface to be ultimately subjected to a high degree of wear during subsequent use and a second surface portion which will interface with a supplemental part for this compound part. The powder-metllurgically-made part is then introduced into a casting mold in such a manner that the above-mentioned second surface will interface with the hot steel in that mold while the contour of the mold cavity proper has a configuration outlining the contour of the compound part to be made other than the first-mentioned first surface portion. Upon solidification of the steel, the steel is unreleasably bonded to the powder-metallurgically-made part and now constitutes the basic or carrier body of the compound part tool made therewith. In accordance with further features of the invention, the high-alloyed steel/nickel/cobalt powders should be provided, prior to press working, with particular hard powdery supplemental components such as corundum or chromium nitrite, or iron carbide or tungsten carbide or a boride. In many instances, it may be of advantage to provide the powder-metallurgically-made part with a porosity established by interconnected and communicating pores so that subsequently a lubricant, a coolant, a separating medium, or the like, can be introduced; the carrier body should then be provided with suitable ducts to run such a liquid or fluid into the powder-metallurgically-made part. The interface between the cast part and the powder-metallurgically-made part should be contoured so that any forces that may arise and have to be reacted from one of these parts into the respective other one, act basically normal to at least a substantial portion of that interface surface. It may be necessary here to provide particular keying surface contours for this purpose.

DESCRIPTION OF THE DRAWINGS

While the specification concludes with claims, particularly pointing out and distincly claiming the subject matter which is regarded as the invention, it is believed that the invention, the objects and features of the invention, and further objects, features and advantages thereof, will be better understood from the following description taken in connection with the accompanying drawings, in which FIG. 1 is a longitudinal section view through a guide arm for guiding billets in a hot-rolling mill;

FIG. 2 is a section view, as indicated by lines A and B in FIG. 1;

FIG. 3 is a cross section through a piercing mandrel tip as is used in tube rolling; and FIG. 4 is a section view as indicated by lines A and B in FIG. 3.

Proceeding now to the detailed description of the drawings, reference is made particularly to FIGS. 1 and 2, illustrating a highly wear-resisting and particularly shaped plate-like body 1, having in the section of FIG. 2 an arcuate configuration. This particular, curved plate 1 is in parts received by and unreleasably connected to a, more or less, flat base body 2. Component 1 has been made by powder-pressing a chromium/nickel steel powder, having two-percentages-by-weight corundum added. The part has, in particular, been made in an isostatic press. Length and width of component 1 are respectively smaller than the overall length and width of carrier part 2. Generally speaking, the surface expected to be subjected to a high degree of wear is a shallow trough or arcuately shaped portion of this particular guide arm, which will be in engagement with a blank or billet in a rolling mill. Therefore, the particular surface of interest is the concavely curved surface of part 1 not in engagement with the carrier 2. The convexly shaped surface portion as well as the small sides of part 1 will become the interface with its carrier (part 2) provided by casting, as will be described below. The particular carrier 2 is provided, in addition, with undercuts 3 at its two ends receiving beveled end portions of part 1, which are, of course, integral with the plate 1 and have been made pursuant to the powder-press-working process outlined above. These undercut portions 3 of part 2 as well as the beveled end portions of part 1 do of course serve for clamping these parts to each other.

After the arcuate bar or plate 1 has been made by press working, the porous product resulting from that press working is sintered. Next, this part is placed into a mold (not shown), being filled with a nonalloyed steel melt. The contour of that mold is selected so that the carrier 2 is now made with the sintered plate 1, serving as an upper boundary of the mold but being intimately combined with part 2 as it is now resulting from this casting process. Upon removal and solidification, the component parts are as shown in FIGS. 1 and 2. There has, in fact, been produced an unreleasable bond between the powder-metallurgical part 1 and a cast area 2.

FIGS. 3 and 4 illustrate a piercing mandrel tip, being made as a compound component and including, in particular, a tip or front 4 proper which has been made from chromium/nickel steel powder being pressed into the shape as illustrated by means of an isostatic press. The carrier body 5 has been cast thereon by inserting this pre-made part 4 in a mold in order to complete the particular component 5 by such a casting process. As can be seen particularly from FIG. 4, the inserted portion of carrier body 5 is of a cross-like cross section due to the corresponding contour of part 4. This configuration is desirable in order to permit a torque between them while preventing part 4 from rotating relatively to part 5. On the other hand the contour of the interface between the part 4 and 5 as shown in FIG. 3, shows that part 4 cannot be slipped off part 5, due to the bulging contour of what could be termed the front portion of part 5. The particular mold, in which carrier body 5 is being cast, includes, of course, contour-defining portions for obtaining the opening 7, in which the mandrel rod will be inserted later. Also, a duct 6 has to be provided for both, inside body 5 and—continued in a blind bore-like fashion—in powder-made part 4. This duct is provided so that a liquid lubricant and/or coolant can be introduced to reach the porous part 4, and it can then penetrate that tip part 4 in a continual fashion in order to maintain cooling and/or lubricating conditions during subsequent use. The casting process of carrier body 5 provides the duct 7, and the powder-metallurgically-made part 4 has been provided with a continuing duct and blind-bore portion as illustrated.

The four figures illustrate examples for making hot-working tools which offer particular advantages over conventionally made tools. In the past, the tools as a whole had to be cast from a very high-quality, high-alloyed material due to the relative complexity of their respective contour. After wearing down by 10% of its weight, the particular tool had to be thrown away. If the parts are, however, made as illustrated and described, one can see that the zones of extensive wear are made of a very high-quality, powder-metallurgically-made component, having a high degree of wear resistance while the basic or carrier body is made of conventional an relatively inexpensive steel. The mold needed in each one of these instances as described completes, so to speak, the particular tool as a whole, and any complexity is in this case just required for and by the casting mold whereby pursuant to the casting process the previously made highly wear-resisting component bonds intimately to the molten steel material and constitutes in part a completing element of the mold which then becomes a portion of the final product. The strength of the casting material can be selected as desired; but usually there are no particular requirements. All of the specific requirements are, so to speak, thrown into the powder-metallurgically-made part onto which the remainder is cast. Conceivably however the casting material can have the same basic chemical and metallurgical composition as the powder from which the powder part has been made; but casting is of course still considerably less expensive than making either one of the tools powder-metallurgically in their entirety.

The figures also reveal that the assembly of this compound part is, in each instance, considerably simplified as compared to prior-art methods. If each one of these parts 1 and 4, on one hand, and parts 2 and 5, on the other hand, had to be separately made and machined one can see that the complexity of their interface would require extreme accuracy of dimensioning. In the present case, such accuracy is not only not required, but the tolerances of the particular surface portion of the powder-metallurgically-made part, which will later form the interface with the cast part, can be very poor because the casting process will, of course, obliterate any inaccuracies, and the bond between the cast and the powder-metallurgical part is entirely independent from any accuracy of the interfacing surfaces. Most certainly then, there is no fine finish of any of these surfaces involved.

The cross-like portion of the interface between the two parts as shown in FIG. 4 is, of course, an example of howone can provide interfacing surfaces, in general, by means of which large forces can be transmitted which, basically, will react perpendicularly to interfacing surfaces. Generally speaking one can use grooves, pins, serrations, or the like, in addition or in the alternative, to be provided for and worked into the surface of the powder-metallurgical part which, later on, will become the interface with the cast part; and the mating contour, of course, are established during casting, resulting in positive connections by means of which large forces can be transmitted without separating the two parts from each other.

FIGS. 3 and 4 are also a particular example for a situation in which the powder-metallurgical part is to remain porous in order to permit penetration of a fluid or liquidous material during subsequent use. As stated generally, a coolant or a lubricant can be used here and in other cases. The cast part must provide for appropriate conduction of a particular fluid in order to flow toward and into the porous, powder-metallurgically-made part. This then permits, of course, adequate treatment of the powder-metallurgically-made part during operation to reduce its wear, a void welding-on, etc. As an example for the fluid to be introduced in this and other cases, one can think of watery salt solutions, steam, thin fluid silicate, etc.

Although not mentioned specifically in any one of these two examples, one should also consider the possibility of introducing into the pores of the powder-metallurgical part that has been made of a particularly hard, strong material, such as oxides, nitrites, carbides, borite or corundum. This will have, of course, the effect of enhancing the wear resistivity of this particular part to a considerable degree.

It should be realized that the powder-metallurgically-made parts do not have to be homogenic, but may have been made stepwise in a laminated fashion, whereby different strata or lamina consist of powder particles of different sizes and/or differently alloyed powders and/or different or absence/presence of nonmetallic additives of different compositions. The earlier mentioned inclusion of for example nitrates or other particularly hard materials could be restricted to the surface-near zones or even to just portions of that surface zone of the powder-metallurgical part.

The invention is not limited to the embodiments described above; but all changes and modifications thereof, not constituting departures from the spirit and scope of the invention, are intended to be included.

I claim:

1. A tool for the hot-working of steel or the like, comprising:

a first part, being a powder-metallurgical part having a surface-defining wear zone for the tool; and a second part, being a steel part having been cast onto the first part and being intimately bonded thereto; a bond having resulted from interfacing of the first part with the molten steel during casting, thereby establishing the compound tool.

2. A tool as in claim 1, the first part being porous with a continual porosity.

3. A tool as in claim 2, the pores defining the porosity being filled with a fluid.

4. A tool as in claim 2 or 3, the second part including duct means interfacing with the first part for running a fluid to the porosity.

5. A tool as in claim 1, the first and second parts having an interface that includes force-transmitting keying surfaces.

6. A tool as in claim 1, the first part being stratified.

7. The method of making a compound, hot-working steel tool having particular surface zones expected to experience heavy wear, comprising:

making a first part of such a compound tool by powder-metallurgically-press-working and sintering powder, the first part having a first surface portion which will become said surface zone, further having a second surface portion;

casting a second part from molten steel in a mold while using the first part in the casting process, the molten steel interfacing with said second surface portion and being cast around a part of the first part and said second surface portion; and causing the molten steel to solidify for establishing a carrier for the tool, being unreleasably bonded to the first part through an interface that includes said second surface portion, said second surface portion being configured for clamping the first part to the second part.

8. A method as in claim 7, said first-part-making step including the step of providing the first part with a continual porosity.

9. A method as in claim 7 or 8, including the step of using at least one of the following: a high-alloyed steel powder, and/or nickel-alloyed powder, and/or cobalt alloy powder, and adding a powderous, hard material for enhancing the wear resistivity of the tool to be made.

10. A method as in claim 9, said hard material being of or including corundum and/or chromium nitrite and/or iron carbide and/or tungsten carbide and/or boride.

11. A method as in claim 7, the metallurgical press working including the step of stratifying the first part, the parts differing by grain size and/or powder composition and/or absence or presence of hardness-enhancing additives.

* * * * *